US008055500B2

(12) United States Patent
Kim et al.

(10) Patent No.: US 8,055,500 B2
(45) Date of Patent: Nov. 8, 2011

(54) METHOD, MEDIUM, AND APPARATUS ENCODING/DECODING AUDIO DATA WITH EXTENSION DATA

(75) Inventors: Junghoe Kim, Yongin-si (KR); Eunmi Oh, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 629 days.

(21) Appl. No.: 11/546,433

(22) Filed: Oct. 12, 2006

(65) Prior Publication Data

US 2007/0083363 A1 Apr. 12, 2007

Related U.S. Application Data

(60) Provisional application No. 60/725,317, filed on Oct. 12, 2005, provisional application No. 60/726,159, filed on Oct. 14, 2005.

(30) Foreign Application Priority Data

May 30, 2006 (KR) ..... 10-2006-0049081
May 30, 2006 (KR) ..... 10-2006-0049082
Jul. 19, 2006 (KR) ..... 10-2006-0067705

(51) Int. Cl.
*G10L 19/02* (2006.01)

(52) U.S. Cl. ..... 704/229; 704/200.1; 704/500; 704/501

(58) Field of Classification Search ..... 704/500, 704/501, 219, 201, 200.1
See application file for complete search history.

(56) References Cited

U.S. PATENT DOCUMENTS

| | | | | |
|---|---|---|---|---|
| 5,956,674 | A * | 9/1999 | Smyth et al. | 704/200.1 |
| 6,182,031 | B1 * | 1/2001 | Kidder et al. | 704/205 |
| 6,349,284 | B1 * | 2/2002 | Park et al. | 704/500 |
| 6,446,037 | B1 * | 9/2002 | Fielder et al. | 704/229 |
| 7,260,225 | B2 * | 8/2007 | Teichmann et al. | 381/10 |
| 2004/0068399 | A1 * | 4/2004 | Ding | 704/200.1 |
| 2005/0081134 | A1 | 4/2005 | Schroeder | |
| 2006/0015332 | A1 * | 1/2006 | Chen et al. | 704/230 |
| 2006/0023888 | A1 * | 2/2006 | Henn et al. | 381/1 |

FOREIGN PATENT DOCUMENTS

| | | |
|---|---|---|
| CN | 1532809 A | 9/2004 |
| CN | 1589468 A | 3/2005 |
| EP | 1 536 410 | 6/2005 |
| KR | 1020040086878 | 10/2004 |
| WO | 00/48402 | 8/2000 |
| WO | 03/077235 | 9/2003 |

(Continued)

OTHER PUBLICATIONS

Wolters et al. "A closer look into MPEG-4 High Efficiency AAC." AES Oct. 2003.*

(Continued)

*Primary Examiner* — Talivaldis Ivars Smits
*Assistant Examiner* — Shaun Roberts
(74) *Attorney, Agent, or Firm* — Staas & Halsey LLP

(57) ABSTRACT

A method, medium, and apparatus encoding/decoding audio data in which audio data is hierarchically encoded, and at least one extension data of the audio data is encoded using at least one encoding method, and decoding is performed in the same manner, thereby ensuring fine grain scalability (FGS) and unlimited extendibility of the audio data.

46 Claims, 15 Drawing Sheets

FOREIGN PATENT DOCUMENTS

| | | |
|---|---|---|
| WO | 03/081196 | 10/2003 |
| WO | 2004/008806 | 1/2004 |
| WO | 2004/097796 | 11/2004 |

OTHER PUBLICATIONS

Baumgarte et al. "Audio Coder Enhancement Using Scalable Binaural Cue Coding with Equalized Mixing." AES May 2004.*

Extended European Search Report mailed Apr. 19, 2010 corresponds to European Patent Application No. 067991810.0-1224.

"Subpart 11: Technical description of Audio Lossless Coding for lossless coding of audio signals", ISO/IEC 14496-3:2005/AMD. 2:2006 (E) 2006, pp. 16-84.

"Information technology—Coding of audio-visual objects—Part 3: Audio Amendment 2: Audio Lossless Coding (ALS), new audio profiles and BSAC extensions", ISO/IEC 14496-3 Third Edition Dec. 1, 2005 Amendment 2, Mar. 15, 2006 pp. 1-18.

Brinker, A.C. den et al., "An Overview of the Coding Standard MPEG-4 Audio Amendments 1 and 2: HE-AAC, SSC, and HE-AAC v2", Hindawi Publishing Corporation EURASIP Journal on Audio, Speech, and Music Processing vol. 2009, Article ID 468971, 21 pages doi: 101155/2009/468971.

Sang-Wook Kim et al., "International Organisation for Standardisation Organisation Internationale de Normalisation ISO/IEC JTC1/SC29/WG11 Coding of Moving Pictures and Audio", ISO/IEC JTc1/Sc29/WG11, MPEG2005/M12079, Apr. 2005, Busan, Korea.

Chinese Patent Office Action mailed Nov. 23, 2010, corresponds to Chinese Patent Application No. 200680038064.4.

European Examination Report mailed Dec. 15, 2010, corresponds to European Patent Application No. 06 799 181.0-1224.

* cited by examiner

FIG. 1A (PRIOR ART)

```
Syntax                                                    No. of bits    Mnemonic
bsac_raw_data_block()
{
    bsac_base_element();
    layer=slayer_size;
100 while(data_available() && layer<(top_layer+slayer_size)) {
        bsac_layer_element(layer);
        layer++;
    }
    byte_alignment();
    if (data_available()) {
        zero_code                                         32             bslbf
        extension_type                                    8              bslbf
        while( data_available() ) {
            switch(extension_type) {
                case EXT_BSAC_CHANNEL :
                    extended_bsac_raw_data_block();
110             case EXT_BSAC_SBR_DATA :
                    extended_bsac_sbr_data(nch, 0);
                case EXT_BSAC_SBR_DATA_CRC :
                    extended_bsac_sbr_data(nch, 1);
            }
        }
    }
}
```

| SYMBOL | VALUE OF EXTENSION_TYPE | PURPOSE |
|---|---|---|
| EXT_BSAC_CHANNEL | '1111 1111' | BSAC CHANNEL EXTENSION |
| EXT_BSAC_SBR_DATA | '1111 0000' | BSAC SBR ENHANCEMENT |
| EXT_BSAC_SBR_DATA_CRC | '1111 0001' | BSAC ENHANCEMENT WITH CRC |

FIG. 3

| Symbol | Value of extension_type | Purpose |
|---|---|---|
| EXT_BSAC_CHANNEL | '1111' | BSAC channel extension |
| EXT_BSAC_SBR_DATA | '0000' | BSAC SBR enhancement |
| EXT_BSAC_SBR_DATA_CRC | '0001' | SBR enhancement with CRC |
| EXT_BSAC_CHANNEL_SBR | '1110' | BSAC channel extension with SBR |
| EXT_BSAC_CHANNEL_SBR_CRC | '1101' | BSAC channel extension with SBR_CRC |
| RESERVED | '0010' ~ '1100' | reserved |

FIG. 11

| Syntax | No. of bits | Mnemonic |
|---|---|---|
| bsac_raw_data_block() | | |
| { | | |
| bsac_base_element(); | | |
| layer=slayer_size; | | |
| 1100 while(data_available() && layer<(top_layer+slayer_size)) { | | |
| bsac_layer_element(layer); | | |
| layer++; | | |
| } | | |
| 1105 byte_alignment(); | | |
| 1110 if (data_available()) { | | |
| 1115 **zero_code** | **32** | **bslbf** |
| 1120 **sync_word** | **4** | **bslbf** |
| 1125 while( bits_to_decode() > 4 ) { | | |
| 1130 **extension_type** | **4** | **bslbf** |
| switch(extension_type) { | | |
| 1140 case EXT_BSAC_CHANNEL : | | |
| 1145 extended_bsac_raw_data_block(); | | |
| break; | | |
| 1150 case EXT_BSAC_SBR_DATA : | | |
| 1155 extended_bsac_sbr_data(nch, 0); | | |
| break; | | |
| 1160 case EXT_BSAC_SBR_DATA_CRC : | | |
| 1165 extended_bsac_sbr_data(nch, 1); | | |
| break; | | |
| 1170 case EXT_BSAC_CHANNEL_SBR : | | |
| 1175 extended_bsac_raw_data_block(); | | |
| 1180 extended_bsac_sbr_data(nch, 0); | | |
| break; | | |
| 1185 case EXT_BSAC_CHANNEL_SBR_CRC : | | |
| 1190 extended_bsac_raw_data_block(); | | |
| 1195 extended_bsac_sbr_data(nch, 1); | | |
| break; | | |
| 1196 default : | | |
| 1197 extended_bsac_data(); | | |
| break; | | |
| } | | |
| } | | |
| 1198 byte_alignment(); | | |
| } | | |
| } | | |

FIG. 12

| Syntax | No. of bits | Mnemonic |
|---|---|---|
| extended_bsac_sbr_data(nch, crc_flag) | | |
| { | | |
| num_sbr_bits = 0; | | |
| cnt = **count**; | **4** | **uimsbf** |
| num_sbr_bits += 4; | | |
| if (cnt == 15) { | | |
| cnt += **esc_count** - 1; | **8** | **uimsbf** |
| num_sbr_bits += 8; | | |
| } | | |
| if (crc_flag) { | | |
| **bs_sbr_crc_bits**; | **10** | **uimsbf** |
| num_sbr_bits += 10; | | |
| } | | |
| num_sbr_bits += 1; | | |
| if (**bs_header_flag**) | **1** | **uimsbf** |
| num_sbr_bits += sbr_header(); | | |
| num_sbr_bits += bsac_sbr_data(nch, bs_amp_res); | | |
| num_align_bits = (8*cnt - num_sbr_bits); | | |
| **bs_fill_bits**; | num_align_ bits | **uimsbf** |
| } | | |

FIG. 13

| Syntax | No. of bits | Mnemonic |
|---|---|---|
| bsac_sbr_data(nch, bs_amp_res) | | |
| { | | |
| Switch (nch) { | | |
| case 1 | | |
| sbr_single_channel_element(bs_amp_res) | | |
| break; | | |
| case 2 | | |
| sbr_channel_pair_element(bs_amp_res) | | |
| break; | | |
| } | | |
| } | | |

FIG. 14

| Syntax | No. of bits | Mnemonic |
|---|---|---|
| extended_bsac_data() | | |
| { | | |
| cnt = **count**; | **8** | **uimsbf** |
| if (cnt == 255) { | | |
| cnt += **esc_count** - 1; | **8** | **uimsbf** |
| } | | |
| for ( i=0 ; i < cnt-1 ; i++) { | | |
| **byte_payload** | **8** | **uimsbf** |
| } | | |
| } | | |

FIG. 15

| | |
|---|---|
| **sync_word** | a four bit code that identifies the start of the extended part. The bit string '1111'. |
| **extension_type** | a four bit code that identifies the extension type |
| extended_bsac_sbr_data () | Syntactic element that contains the SBR extension data for ER BSAC |
| **count** | Initial length of extended_bsac_sbr_data() or extended_bsac_data() |
| **esc_count** | Incremental length of extended_bsac_sbr_data() or extended_bsac_data() |
| **bs_sbr_crc_bits** | Cyclic redundancy checksum for the SBR extension data. The CRC code is defined by the generator polynomial $G_{10}(x) = x^{10} + x^9 + x^5 + x^4 + x + 1$ and the initial value for the CRC calculation is zero |
| **bs_header_flag** | Indicates if an SBR header is present |
| sbr_header () | Syntactic element that contains the SBR header. See Table 4.56-Syntax of sbr_header() |
| bsac_sbr_data() | Syntactic element that contains the SBR data for ER BSAC |
| **bs_fill_bits** | Byte alignment bits |
| sbr_single_channel_element() | Syntactic element that contains data for an SBR single channel element. |
| sbr_channel_pair_element() | Syntactic element that contains data for an SBR channel pair element. |
| extended_bsac_data() | Syntactic element that contains the payload to be discarded by decoder. This is for the further extensions. |
| bits_to_decode() | A helper function; returns the number of bits not yet decoded in the current bsac_raw_data_block (). |
| **byte_payload** | Byte to be discarded by the decoder |

METHOD, MEDIUM, AND APPARATUS ENCODING/DECODING AUDIO DATA WITH EXTENSION DATA

CROSS-REFERENCE TO RELATED APPLICATIONS

This application claims the priority of U.S. Provisional Application No. 60/725,317, filed on Oct. 12, 2005, and No. 60/726,159, filed on Oct. 14, 2005, and priority of Korean Patent Application Nos. 10-2006-0049081 and 10-2006-0049082, both filed on May 30, 2006, and No 10-2006-0067705, filed Jul. 19, 2006, in the Korean Intellectual Property Office, the disclosures of which are incorporated herein in their entirety by reference.

BACKGROUND OF THE INVENTION

1. Field of the Invention

An embodiment of the present invention relates to a method, medium, and apparatus encoding/decoding audio data, and more particularly, to a method, medium, and apparatus encoding/decoding audio data with extension data that can be used to extend the audio data.

2. Description of the Related Art

When encoding and/or decoding audio data, the audio data can be processed using extension data that provides information for extending the available uses for the audio data. As an example, extension data may include data for extending a channel of audio data, data for extending a bandwidth of audio data, data for generating a code for checking for transmission errors in the received audio data, etc. In addition, extension data may further include metadata of audio data, a fill element of audio data, etc.

FIG. 1A illustrates a conventional syntax for audio data and extension data, and FIG. 1B illustrates a corresponding table of exemplary values of the "extension_type" illustrated in FIG. 1A.

A portion of the syntax identified by reference numeral 100 in FIG. 1A is for the hierarchical decoding of the audio data, and another portion of the syntax identified by reference numeral 110 is for the decoding of the extension data. Referring to reference numeral 110, the recited "extension_type" appears after "zero_code", which is a code indicating the termination of a payload corresponding to the audio data. This syntax "extension_type" is an identification code indicating the type of extension data and enables a decoding unit to parse the type of the extension data in a payload transmitted from an encoding unit. According to the syntax in FIG. 1A, using extension data, the channel or the bandwidth of audio data can be extended, or the bandwidth of the audio data can be extended and a code for checking for transmission errors in the received extension data, the bandwidth of audio data, can be generated.

However, multi-channel audio coding, which can be a very useful Spectral Band Replication (SBR) tool, cannot be implemented by the conventional syntax of FIG. 1A. In other words, the channel and the bandwidth of audio data cannot be simultaneously extended using the extension data in the syntax of FIG. 1A. For example, in a payload shown in FIG. 1C, for bit sliced arithmetic coding (BSAC), the "BSAC Center" indicated by reference numeral 130 cannot be identified by a decoding unit and cannot appear in an encoding terminal. Therefore, with such conventional encoding and decoding of audio data, there is a limit to the available extending of the extension data of the audio data using various methods.

SUMMARY OF THE INVENTION

An embodiment of the present invention provides an apparatus, medium, and method allows for nearly unlimited extensibility of audio data while providing backward compatibility.

Additional aspects and/or advantages of the invention will be set forth in part in the description which follows and, in part, will be apparent from the description, or may be learned by practice of the invention.

To achieve at least the above and/or other aspects and advantages, embodiments of the present invention include an encoding method, including encoding audio data using at least one encoding method, and encoding at least one extension data for the audio data using at least one encoding method.

In the encoding of the audio data, the audio data may be hierarchically encoded using a first encoding method, and in the encoding of the at least one extension data, the at least one extension data may be encoded using at least one encoding method, including the first encoding method.

In addition, the encoding of the at least one extension data may include encoding data for extending a channel of the audio data. Further, the encoding of the at least one extension data may include encoding data for extending a bandwidth of the audio data. Still further, the encoding of the at least one extension data may include at least one of hierarchically encoding data for extending a channel of the audio data and encoding data for extending a bandwidth of the audio data.

The encoding of the at least one extension data may still further include encoding data for extending a bandwidth of the audio data and encoding a code for checking for transmission errors of the audio data.

The method may further include generating a code indicating a type of the at least one extension data, wherein the encoding of at the least one extension data is performed using at least one encoding method according to the generated code.

Here, the type of the at least one extension data may be at least one selected from a type of data for extending a channel of the audio data, a type of data for extending a bandwidth of the audio data, a type of data for checking for transmission errors of the audio data, metadata of the audio data, and a fill element of the audio data.

The method may further include generating a first code indicating a start of an encoded portion of the at least one extension data, and generating a second code indicating a type of the at least one extension data.

Here, the method may further include inserting a third code indicating an end of an encoded portion of the audio data, immediately after the encoded portion of the audio data, wherein the generating of the first code further includes inserting the first code after the inserted third code, and the generating of the second code further includes inserting the second code after the inserted first code.

The first code may be a 4-bit code with four consecutive identical bits, and the second code may be a different 4-bit code.

In addition, the method may include inserting a code indicating a type of different extension data after an encoded portion of the at least one extension data, and encoding the at least one extension data, wherein the adding of the code and the encoding of the least one extension data are repeatedly performed until all extension data are encoded.

To achieve at least the above and/or other aspects and advantages, embodiments of the present invention include at least one medium including computer readable code to control at least one processing element to implement an embodiment of the present invention.

To achieve at least the above and/or other aspects and advantages, embodiments of the present invention include at least one medium including bitstream information to control a decoding apparatus to decode encoded audio data, the bitstream including the encoded audio data encoded using at least one encoding method, and at least one encoded extension data for the audio data using at least one encoding method.

The bitstream information may further include at least one code with information for any of a start of an encoded portion of the at least one extension data, information identifying a type of the at least one encoded extension data, and information of an end of an encoded portion of the audio data.

Here, the code indicating the end of the encoded portion of the audio data may immediately follow the encoded portion of the audio data, followed immediately by the code for the start of the encoded portion of the at least one extension data, followed immediately by the code identifying the type of the at least one encoded extension data.

To achieve at least the above and/or other aspects and advantages, embodiments of the present invention include an encoding apparatus, including a first encoding unit to encode audio data using at least one encoding method, and a second encoding unit to encode at least one extension data for the audio data using at least one encoding method.

To achieve at least the above and/or other aspects and advantages, embodiments of the present invention include a decoding method, including decoding audio data using at least one decoding method, and decoding at least one extension data for the audio data using at least one decoding method.

Here, in the decoding of the audio data, the audio data may be hierarchically decoded using a first decoding method, and in the decoding of the at least one extension data, the at least one extension data may be decoded using at least one decoding method, including the first decoding method.

The decoding of the at least one extension data may include decoding data for extending a channel of the audio data. In addition, the decoding of the at least one extension data may include decoding data for extending a bandwidth of the audio data. Still further, the decoding of the at least one extension data may include at least one of hierarchically decoding data for extending a channel of the audio data and decoding data for extending a bandwidth of the audio data.

The decoding of the at least one extension data may further include decoding data for extending a bandwidth of the audio data and decoding a code for checking for transmission errors of the audio data.

In addition, the method may include detecting a code indicating a type of the at least one extension data, wherein, when the code indicating the type of the at least one extension data is detected, the decoding of the at least one extension data is performed using at least one decoding method according to the generated code.

Here, the type of the at least one extension data may be at least one selected from a type of data for extending a channel of the audio data, a type of data for extending a bandwidth of the audio data, a type of data for checking for transmission errors of the audio data, metadata of the audio data, and a fill element of the audio data.

The decoding method may further include detecting a first code indicating a start of an encoded portion of the at least one extension data, and detecting a second code indicating a type of the at least one extension data.

Here, the decoding method may further include detecting a third code indicating an end of an encoded portion of the audio data, immediately after the encoded portion of the audio data, wherein the detecting of the first code further includes detecting the first code after the third code if the third code is detected, and the detecting of the second code further includes detecting the second code after the first code if the first code is detected.

The first code may be a 4-bit code with four consecutive identical bits, and the second code may be a different 4-bit code.

The decoding method may further include detecting a code indicating a type of different extension data after an encoded portion of the at least one extension data, and decoding the at least one extension data using a decoding method according to the detected code if the code indicating the type of the different extension data is detected, wherein the detecting of the code and the decoding of the at least one extension data are repeatedly performed until all of the at least one extension data are decoded.

To achieve at least the above and/or other aspects and advantages, embodiments of the present invention include a decoding apparatus, including a first decoding unit to decode audio data using at least one decoding method, and a second decoding unit to decode at least one extension data for the audio data using at least one decoding method.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 1A illustrates a conventional syntax for decoding audio data and extension data;

FIG. 3 illustrates a table of code values of extension type data;

FIG. 11 illustrates a syntax of bsac_raw_data_block( ), according to an embodiment of the present invention;

FIG. 12 illustrates a syntax of extended_bsac_sbr_data (nch.crc_flag), according to an embodiment of the present invention;

FIG. 13 illustrates a syntax of bsac_sbr_data(nch,bs_amp_res), according to an embodiment of the present invention;

FIG. 14 illustrates a syntax of extended_bsac_data( ), according to an embodiment of the present invention; and FIG. 15 illustrates a table of definition of payloads in syntaxes, according to an embodiment of the present invention.

DETAILED DESCRIPTION OF THE PREFERRED EMBODIMENTS

Figures 1B, 1C:
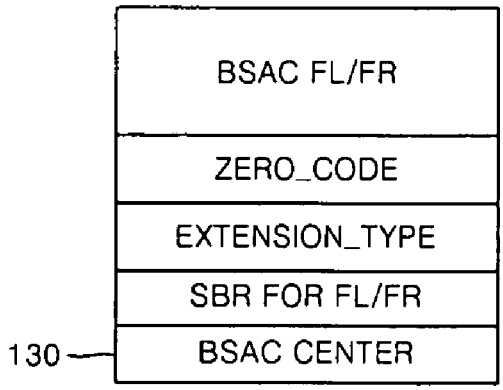
FIG. 1B (PRIOR ART)
FIG. 1C (PRIOR ART)
FIG. 1B illustrates a table of exemplary values of the "extension_type" shown in FIG. 1A.
FIG. 1C illustrates an exemplary conventional payload.

Reference will now be made in detail to embodiments of the present invention, examples of which are illustrated in the accompanying drawings, wherein like reference numerals refer to the like elements throughout. Embodiments are described below to explain the present invention by referring to the figures.

Figure 2:
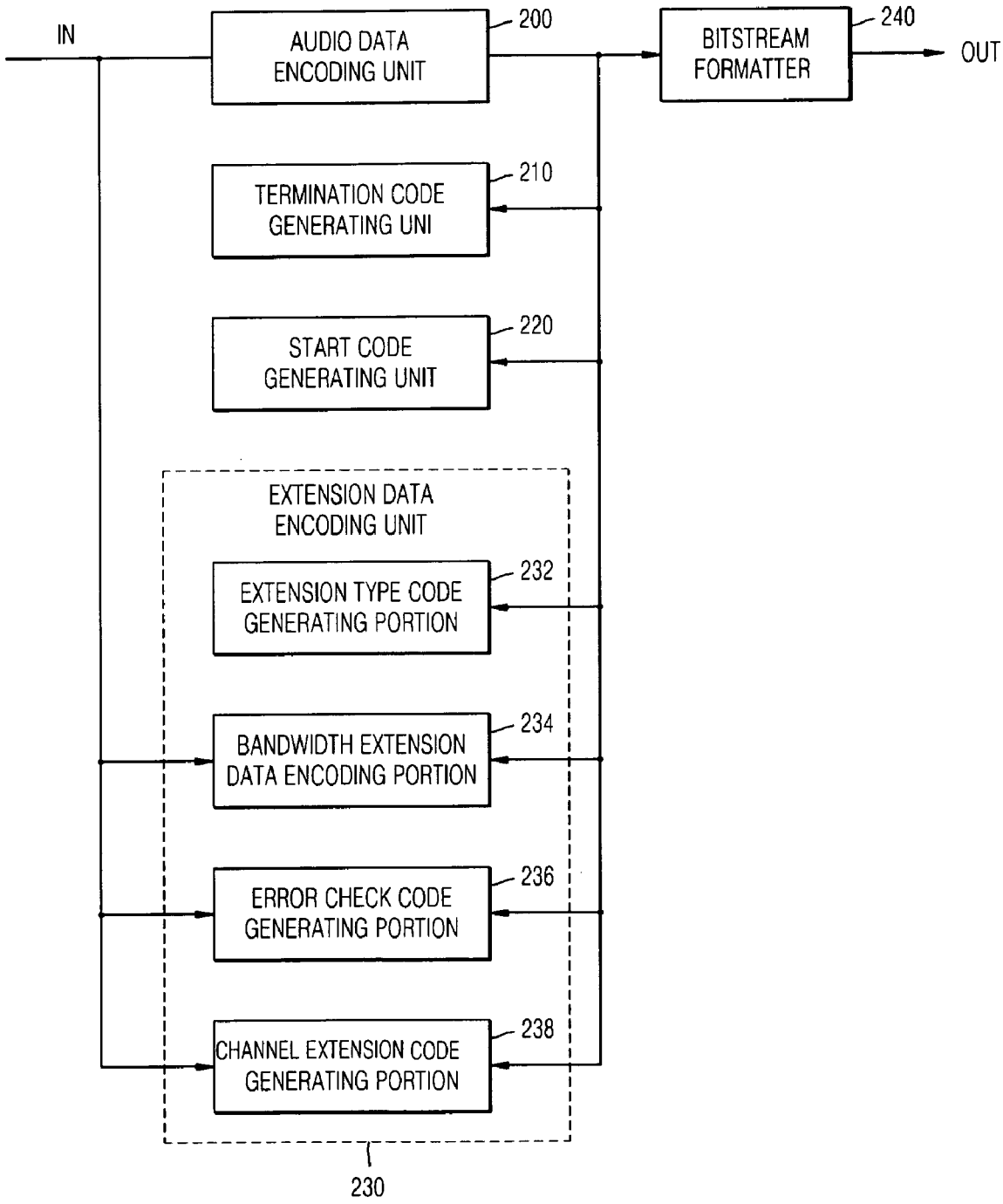
FIG. 2 illustrates an apparatus encoding audio data and extension data, according to an embodiment of the present invention.

FIG. 2 illustrates an apparatus encoding audio data and extension data, according to an embodiment of the present invention. The apparatus of FIG. 2 may include an audio data encoding unit 200, a termination code generating unit 210, a start code generating unit 220, an extension data encoding unit 230, and a bitstream formatter 240, for example.

The audio data encoding unit 200 may encode audio data input through an input data IN and then hierarchically encode the audio data, for example.

Here, the audio data encoding unit 200 may perform bit sliced arithmetic coding (BSAC), as only an example of hierarchical coding. Audio data having a frequency band corresponding to a base layer may initially be encoded, and then audio data having a frequency band corresponding to an upper layer next to the base layer may then be encoded. In an embodiment, this encoding may be repeated until audio data having frequency bands corresponding to all the remaining layers are completely encoded. In particular, a lower frequency band that is detectable by human ears may be assigned to be the base layer, and a higher frequency band may be assigned to be an upper layer. In addition, according to an embodiment, a lower bit rate may be assigned to the lower layer, thereby increasing the transmission reliability of the lower layer, as the base layer most affecting a human's hearing, for example, and allowing smooth transmission in inferior transmission environments. In addition, the number of upper layers and corresponding bit rates may be assigned depending on the audio data transmission environment to provide fine grain scalability (FGS).

When an audio data input to the audio data encoding unit 200 is a multi-channel signal, the audio data encoding unit 200 may select on the multi-channel signal to obtain a stereo signal, and encode the audio data. For example, the audio signal may be encoded after the multi-channel signal is selected into a front-right channel audio signal and a front-left channel audio signal.

Once the audio data encoding unit 200 has completed the encoding of the audio data, the termination code generating unit 210 may generate a termination code to indicate the termination of a payload of the encoded data. In an embodiment, the termination code may be located immediately after the payload of the encoded audio data. In such an embodiment, such as in the syntax of FIG. 11, the termination code is implemented as 'zero_code'. Here, the 'zero_code' may be required to terminate arithmetic decoding and have 32 consecutive '0' s, for example.

When extension data of the audio data, e.g., as encoded by the audio data encoding unit 200, is encoded, the start code generating unit 220 may generate a start code to identify a start of a payload of the extension data. As an example, the start code generated by the start code generating unit 220 may be inserted into a start portion of the payload of the extension data. Again, in an embodiment, such as the syntax of FIG. 11, the start code is implemented as 'sync_word', where, 'sync_word' is a 4-bit code indicating a start of the payload of the extension data and has 4 consecutive '1's. This 'sync_word' may be inserted after 'zero_code'.

The extension data encoding unit 230 may encode extension data of encoded audio data, e.g., as encoded by the audio data encoding unit 200. Here, the extension data refers to data used to process audio data so as to extend the available applications of the audio data. For example, the extension data may include at least one of data for extending the bandwidth of the audio data, data for extending the bandwidth of the audio data, data for generating a code for checking for transmission errors of the data, etc. When extending the bandwidth of the audio data, a Spectral Band Replication (SBR) tool may be used, and a cyclic redundancy checksum (CRC) code may be used as a code for checking for transmission errors of the data, for example.

The extension data encoding unit 230 may further include an extension type code generating portion 232, a bandwidth extension data encoding portion 234, an error check code generating portion 236, and a channel extension data encoding portion 238, for example.

Here, the extension type code generating portion 232 may generate an extension type code to indicate the type of extension data to be encoded by the extension data encoding unit 230. Again, the extension type code is data indicating whether the available applications of the audio data will be extended for a specific purpose. The extension type code generating portion 232 may generate an extension type code that corresponds to the type of the extension data and may be located before the payload of the extension data. Here, the extension type code generating portion 232 may repeatedly generate extension type codes until all the extension data are encoded. For example, in the syntax of FIG. 11, the extension type code may be implemented as 'extension_type'.

FIG. 3 illustrates a table of code values of extension type data, according to an embodiment of the present invention. Referring to FIG. 3, code '1111', which is a code value of "extension_type", indicates extension data for extending the channels of the audio data. As illustrated in FIG. 3, code '0000' is a code value of "extension type" and indicates extension data for extending the bandwidth of the audio data by encoding the audio data using an SBR tool. The illustrated code '0001' is a code value of "extension type" and indicates extension data having data for extending the bandwidth of the audio data by encoding the audio data using an SBR tool and data for generating a CRC code for checking for transmission errors of extension data, the bandwidth of audio data. The code '1110' is a code value of "extension type" and indicates extension data having data for extending the bandwidth of the audio data by encoding the audio data using an SBR tool and data for extending the bandwidth of the audio data. Lastly, code '1101' is a code value of "extension type" and indicates extension data having data for extending the bandwidth of the audio data, data for extending the channel of the audio data, and data for generating a CRC code for checking for a transmission error of the extension data, extending the bandwidth of audio data.

Thus, in this embodiment, one of the reserved values from '0010' to '1100' may be designated as a type of extension data. For example, extension data of audio data may indicate that the audio data is metadata or a fill element, with examples of the metadata of the audio data including a type or words of audio data, etc, and the fill element referring to insignificant bits added to a bitstream to meet a predetermined packet size.

Here, in addition to the above, alternative extension data of audio data may include any other type, in addition to the above-listed extension types.

The bandwidth extension data encoding portion 234 may encode only a predetermined bandwidth of the audio data or a multi-channel audio data, e.g., as encoded by the audio data encoding unit 200, so that the bandwidth of the audio data can be extended in the decoding unit. In particular, the bandwidth extension data encoding portion 234 may encode audio data having a low-frequency band and a multi-channel audio data so that an audio signal having a high-frequency band can be decoded in the decoding unit.

In a method of extending the bandwidth of the audio data, a SBR tool may be used. Here, the SBR tool is a tool of estimating audio data having a high frequency band corresponding to an upper layer separately from audio data having a low frequency band corresponding to a base layer, using the fact that the low frequency band and the high frequency band of the audio data are highly correlated. In other words, information indicating a correlations between the audio data having a maximum frequency of f1 in the base layer and the audio data having a maximum frequency of Fn in the upper layer is encoded. Here, the maximum frequency fn of the audio data may be equal to or greater than a maximum frequency fk of an uppermost layer. In general, the original audio data may include audio data that is not included in the uppermost layer, as the maximum frequency fn of the audio signal may be greater than the maximum frequency fk of the uppermost layer.

Again referring to FIG. 2, the error check code generating portion 236 may generate a code for checking for transmission errors by the decoding unit. Here, the error check code generating portion 236 may generate a CRC code for checking for transmission errors. For example, the error check code generating portion 236 may generate a CRC code for checking a transmission error of only extension data for expanding the bandwidth of smaller audio data. Alternatively, the error check code generating portion 236 may generate a CRC code for checking a transmission error of at least one data, such as audio data or extension data for extending the channel of the audio data, which are transmitted to the decoding unit. The error check code generating portion 236 prepares the code for checking a transmission error of a data in front of the payload of the data to check. For example, the code for checking a transmission error of extension data for extending the channel of the audio data is prepared in front of the payload of extension data for extending the channel of the audio data.

The channel extension data encoding portion 238 may further encode data that may be used to extend the channel of the audio data in the decoding unit.

In an one embodiment, the bitstream formatter 240 may generate a bitstream from the payload and the codes generated by the encoding in the audio data encoding unit 200, the termination code generating unit 210, the start code generating unit 220, and the extension data encoding unit 230, for example, and output the bitstream through an output terminal OUT. The bitstream formatter 240 may generate the bitstream by sequentially multiplexing the payload of the audio data and the termination code, for example. Here, when the extension data is encoded, in addition to the payload of the audio data and the termination code, a start code, a code indicating the type of a first extension data, a payload of the encoded first extension data, a code indicating the type of a second extension data, a payload of the encoded second extension data, . . . , a code indicating the type of an $N^{th}$ extension data, and a payload of the encoded $N^{th}$ extension data may be sequentially multiplexed to generate the bitsteam.

Figure 4:
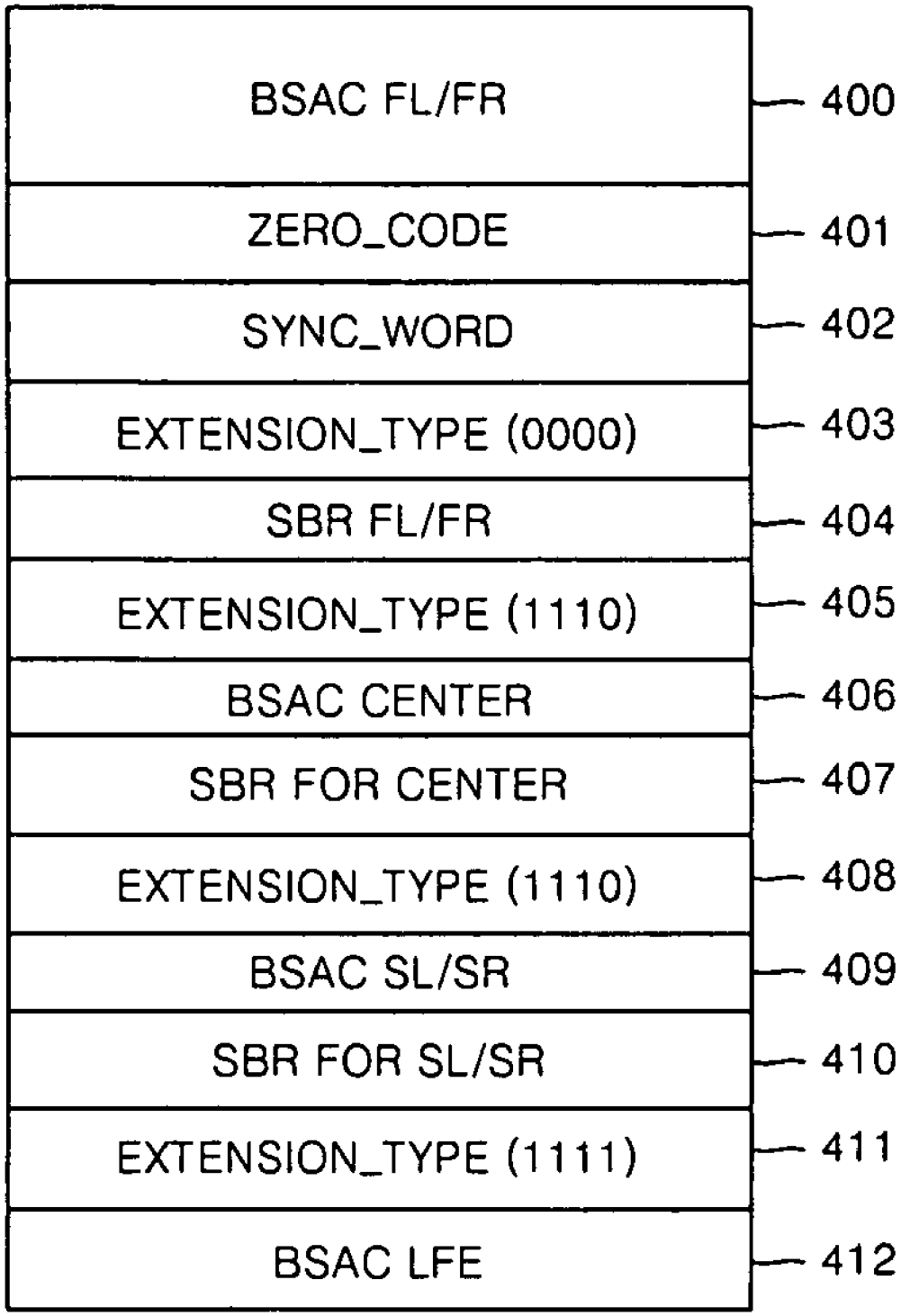
FIG. 4 illustrates an encoded audio data with extension data payload, according to an embodiment of the present invention.

FIG. 4 illustrates an encoded audio data and extension data payload, according to an embodiment of the present invention. Here, an extension type code, indicating each extension data type, may exist before the payload of each extension data. Referring to FIG. 4, reference numeral 400 denotes encoded audio data of front left (FL) and front right (FR) channels, e.g., as encoded in the audio data encoding unit 200. Reference numeral 401 denotes 'zero_code', as a termination code, reference numeral 402 denotes 'sync_word', as a start code, and reference numeral 403 denotes code '0000', as an extension type code indicating extension data for extending the bandwidth of the audio data. In addition, reference numeral 405 denotes '1110', as an extension data type code indicating extension data for extending the channel of the audio data and the bandwidth of the channel-extended audio data. Reference numeral 406 denotes "BSAC Center", as extension data for extending the channel of the audio data to a center channel. Reference numeral 407 denotes "SBR for Center", as extension data extending the bandwidth of the audio data in the C channel. Reference numeral 408 denotes '1110', as an extension type code indicating extension data for extending the channel of the audio data and the bandwidth of the channel-extended audio data. Reference numeral 409 denotes "BSAC SL/SR", as extension data for extending the channel of the audio data to a surround left (SL) channel and a surround right (SR) channel, and reference numeral 410 is extension data for extending the band width of the audio data in the SL channel and the SR channel. Reference numeral 411 denotes '1111', as an extension type code indicating extension data for extending the channel of the audio data. In summary, according to this embodiment of the invention, reference numeral 412 denotes "BSAC LEF", as extension data for extending the channel of the audio data to a low enhancement frequency (LEF) channel.

Figure 5:
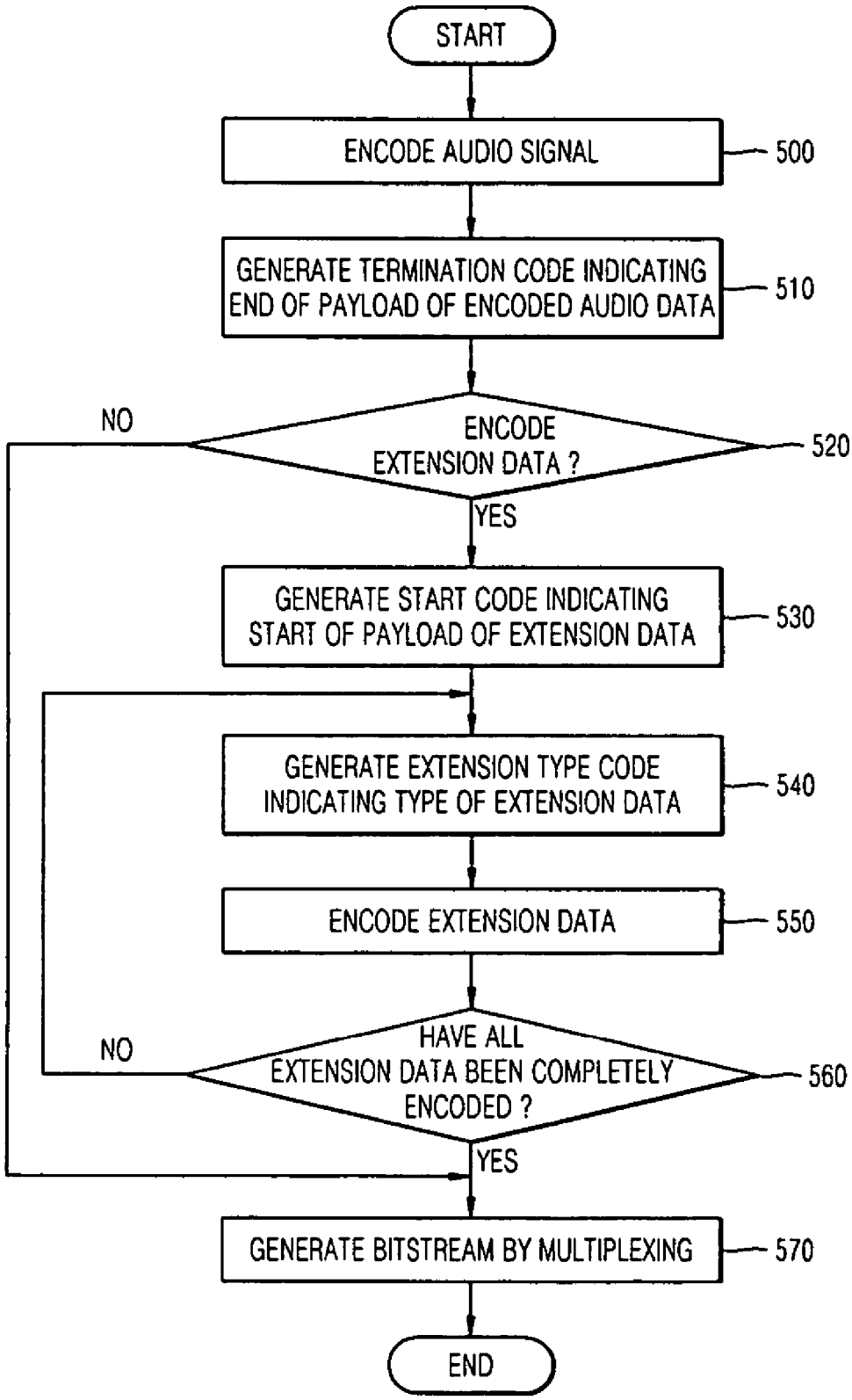
FIG. 5 illustrates a method of encoding audio data and extension data, according to an embodiment of the present invention.

FIG. 5 illustrates a method of encoding audio data and extension data, according to an embodiment of the present invention.

Referring to FIG. 5, initially, an audio signal may be received and encoded, in operation 500. Here, the audio signal may further be hierarchically encoded, for example.

In an embodiment of such a hierarchical encoding, in operation 500, the audio data may be encoding using BSAC, for example. Data having a frequency band corresponding to a base layer, among the audio data, may be encoded first, and data having a frequency band corresponding to an upper layer, e.g., next to the base layer, may be next encoded. Thereafter, encoding may be repeatedly performed until data corresponding to all the remaining layers are completely encoded. Here, a low frequency bandwidth, e.g., which may be detectable by human ears, may be determined to be the base layer, and a higher frequency band may be determined to be the upper layer. In one embodiment, a lower bit rate may be allocated to the lower layer, thereby increasing the transmission reliability in the lower layer, such as the base layer, thereby allowing smooth transmission in a very poor transmission environments. In addition, the number of upper layers and the corresponding bit rates may be determined according to the corresponding transmission environments of the audio data, thereby ensuring fine grain scalability (FGS).

According to an embodiment, in operation 500, when the input audio signal is a multi-channel signal, the encoding may be performed after the multi-channel signal is selected into a stereo signal. For example, after selecting the audio signal of a FR channel and the audio signal of a FL channel, audio data corresponding to a stereo may be encoded.

When the encoding of the audio signal has completed, a termination code indicating an end of the payload of the encoded audio data may be generated, in operation 510. Here, the termination code may be located immediately after the payload of the encoded audio data, for example. According to an embodiment shown in the syntax of FIG. 11, the termination code may be implemented as 'zero_code', with this 'zero_code' being required to terminate arithmetic coding and having of 32 consecutive '0's, for example.

After operation 510, it may be determined whether to encode extension data of the encoded audio data, e.g., as encoded in operation 500, in operation 520. Here, as noted above, the extension data refers to data used to process the audio data so as to extend the available uses of the audio data for a specific purpose.

If it is determined in operation 520 to encode the extension data, a start code to indicate a start of a payload of the extension data may be generated, in operation 530. According to an embodiment, this start code may be inserted where the payload of the extension data starts. In addition, according to the embodiment shown in the syntax of FIG. 11, the start code may be implemented as 'sync_word', where, 'sync_word' is a 4-bit code indicating a start of the payload of the extension data and has 4 consecutive '1's. This 'sync_word' may be inserted immediately after the 'zero_code', for example.

After operation 530, an extension type code indicating the type of the extension data to be encoded may be generated, in operation 540. Here, the extension type code may be data indicating whether the available uses of the audio data will be extended for a specific purpose.

Extension data corresponding to the extension type code, generated in operation 540, may further be encoded, in operation 550.

After operation 550, it may be determined whether there is additional extension data to be encoded, in operation 560.

If it is determined that there is additional extension data to be encoded, operations 540 to 560 may be repeatedly performed, for example.

If it is determined that there is no additional extension data to be encoded, a bitstream may be generated, according to an embodiment, by sequentially multiplexing the payload of the encoded audio data and the termination code, in operation 570. When all the extension data are encoded, the bitstream may be generated by sequentially multiplexing the start code, an extension type code indicating the type of a first extension data, a payload of the of the encoded first extension data, an extension type code indicating the type of a second extension data, . . . , an extension type code indicating the type of an $N^{th}$ extension data, and a payload of the encoded Nth extension data, in addition to the above-described payload and the termination code, for example.

Figure 6:
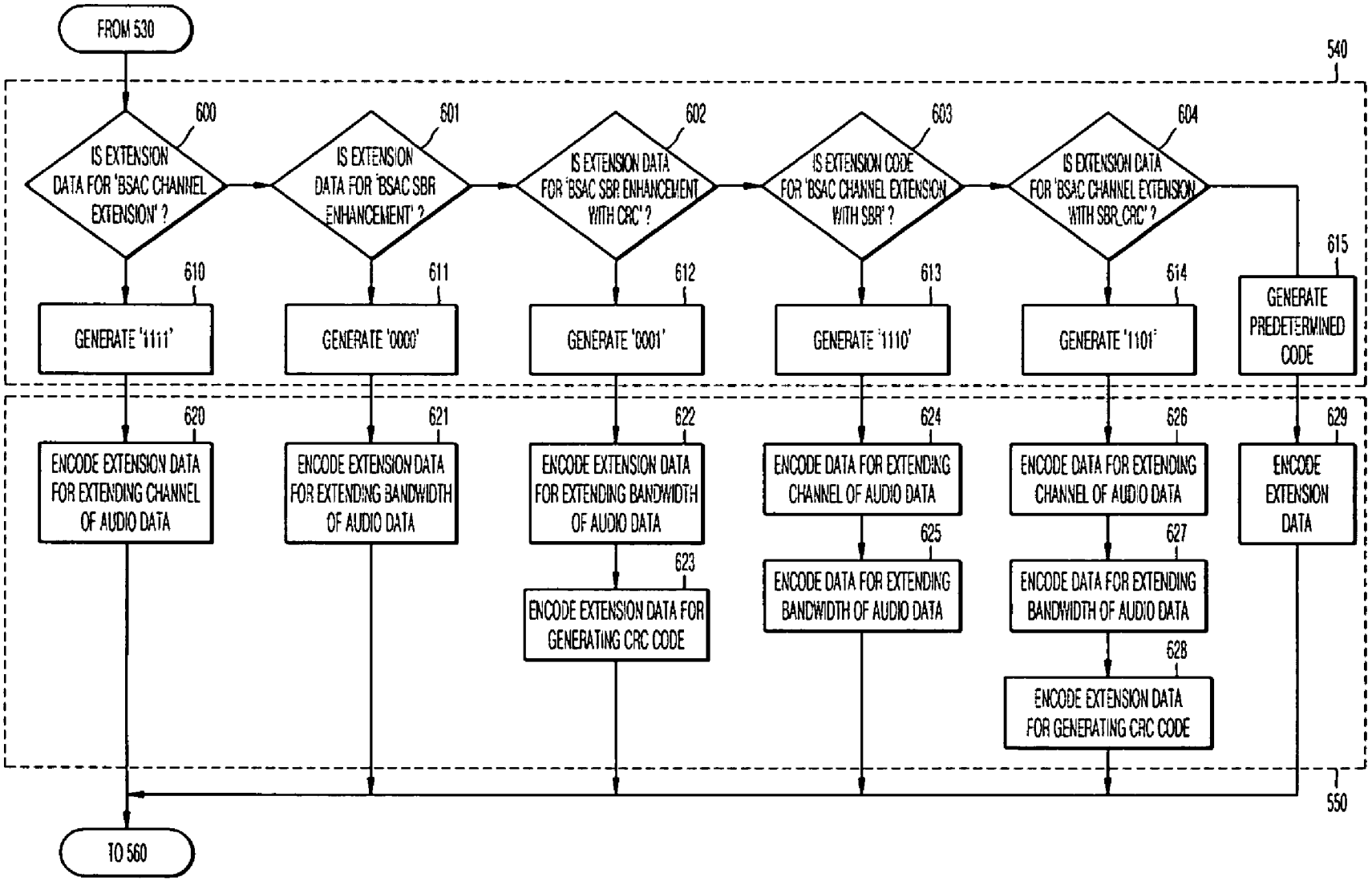
FIG. 6 illustrates operations in a method of audio data and extension data, such as operations 540 and 550 of FIG. 5, according to an embodiment of the present invention.

FIG. 6 illustrates operations of a method of audio data and extension data encoding, such as operations 540 and 550 of FIG. 5, according to an embodiment of the present invention.

According to this embodiment, after the above operation 530, it is determined whether the extension data to be encoded is data for extending the channel of the audio data encoded by BSAC, which is simply expressed as 'BSAC channel extension', operation 600.

If it is determined that the extension data is data for the 'BSAC channel extension', code '1111' may be generated as a value of "extension_type", indicating the type of the audio data, in operation 610. After operation 610, the extension data for extending the channel of the audio data may be encoded, in operation 620. A payload of the extension data, e.g., as encoded in operation 620, may be located immediately after the extension type code '1111', e.g., as generated in operation 610.

If it is determined that the extension data is not data for expanding the channel of the audio data, it is determined whether the extension data to be encoded is data for extending the bandwidth of the audio data, which may be simply expressed as 'BSAC SBR enhancement', in operation 601.

If it is determined that the extension data is data for extending the bandwidth of the audio data, code '0000' may be generated as a value of "extension_type", indicating the type of the audio data, in operation 611. After operation 611, the extension data for extending the bandwidth of the audio data may be encoded, in operation 621. According to an embodiment, the payload of the extension data, e.g., as encoded in operation 621, may be located immediately after the extension type code '0000' generated in operation 611.

If it is determined that the extension data is not data for extending the bandwidth of the audio data, it is determined whether the extension data to be encoded is data for extending the bandwidth of the audio data and generating a CRC code for checking for transmission errors of the extension data of extending the bandwidth of audio data, which may simply be expressed as 'BSAC SBR enhancement with CRC', in operation 602.

If it is determined that the extension data to be encoded includes data for extending the bandwidth of the audio data and data for generating a CRC code for checking for transmission errors of the audio data, code '0001' may be generated as a value of "extension_type", indicating the type of the extension data, in operation 612. After operation 612, the data for extending the bandwidth of the audio data may be encoded, in operation 622, and the data for generating the CRC code for checking for transmission errors of the extension data of extending the bandwidth of audio data may be encoded, in operation 623. According to an embodiment, the payload of the extension data, e.g., as encoded in operations 622 and 623, may be located immediately after the extension type code '0001' generated in operation 612.

If it is determined that the extension data to be encoded is not data for extending the bandwidth of the audio data and generating a CRC code for checking for transmission errors of the extension data of extending the bandwidth of audio data, it may be determined whether the extension data to be encoded is data for extending the channel and the bandwidth of the audio data in operation 603.

If it is determined that the extension data includes data for extending the channel of the audio data and data for extending the bandwidth of the audio data, code '1110' may be generated as a value of "extension_type", indicating the type of the extension data, in operation 613. After operation 613, the data for extending the channel of the audio data may be encoded, in operation 624, and the data for extending the bandwidth of the audio data may be encoded, in operation 625. According to an embodiment, the payload of the extension data, e.g., as encoded in operations 624 and 625, may be located immediately after the extension code type '1110' generated in operation 613.

If it is determined that the extension data does not include data for extending the channel of the audio data and data for extending the bandwidth of the audio data, it may be determined in operation 604 whether the extension data to be encoded includes data for extending the channel of the audio data, data for extending the bandwidth of the audio data, and data for generating a CRC code for checking a transmission error of the extension data of extending the bandwidth of audio data, which may be simply expressed as 'BSAC channel extension with SBR_CRC', for example.

If it is determined that the extension data includes data for extending the channel of the audio data, data for extending the bandwidth of the audio data, and data for extending the bandwidth of the audio data, code '1101', as a value of "extension_type", indicating the type of the extension data, may be generated in operation 614. After operation 614, the data for extending the channel of the audio data may be encoded, in operation 626, the data for extending the bandwidth of the audio data may be encoded, in operation 627, and the data for generating a CRC code for checking a transmission error of the extension data of extending the bandwidth of audio data may be encoded, in operation 628. According to an embodiment, the payload of the extension data, e.g., as encoded in operations 626, 627, and 628, may be immediately located after the extension code type '1101' generated in operation 614.

If it is determined that the extension data does not include data for extending the channel of the audio data, data for extending the bandwidth of the audio data, and data for generating a CRC code for checking a transmission error of the audio data, a predetermined code '0010' or '1100' may be generated in operation 615. A type of extension data corresponding to the code generated in operation 615 may further be encoded in operation 629.

Figure 7:
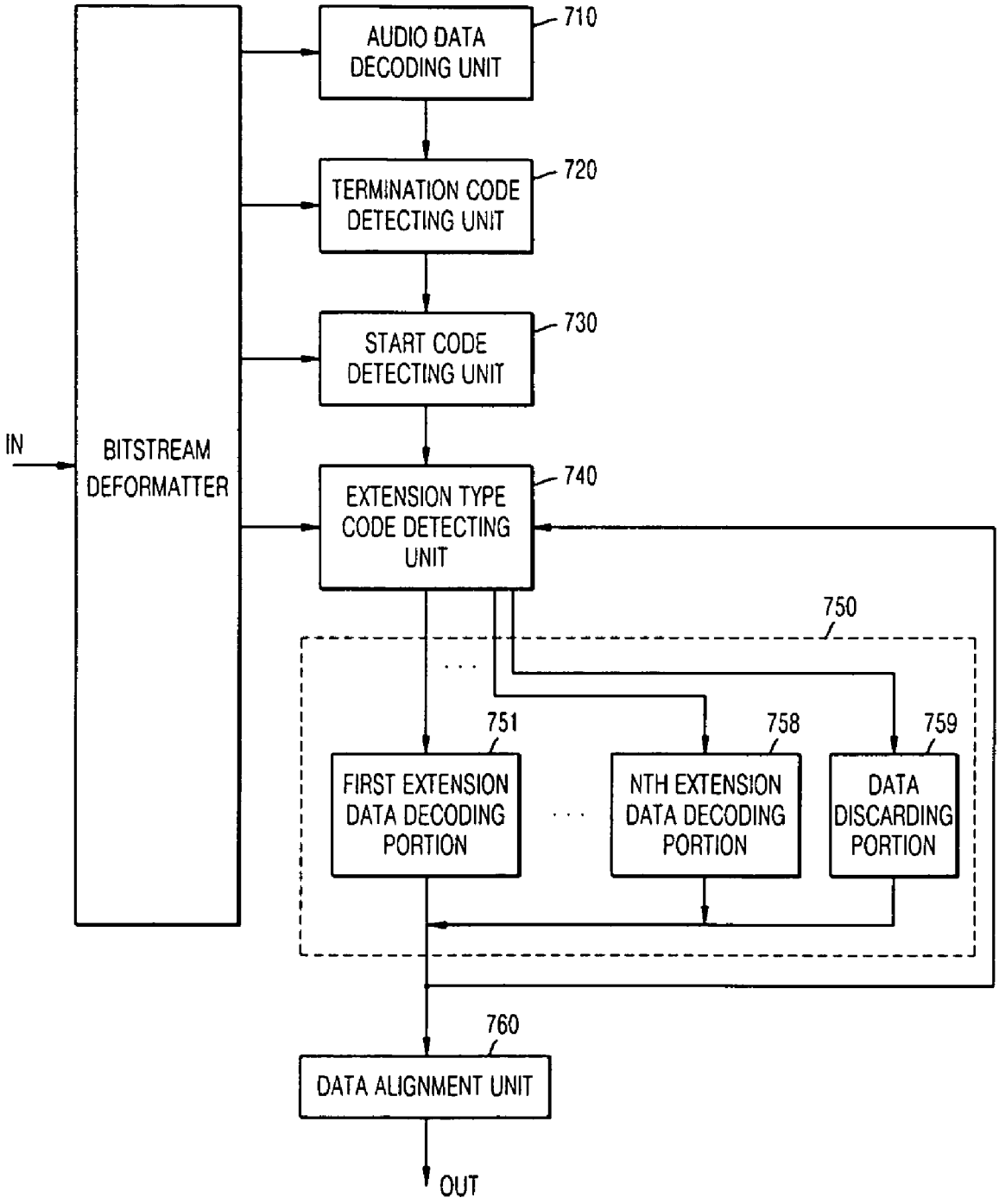
FIG. 7 illustrates an apparatus for decoding audio data and extension data, according to an embodiment of the present invention.

FIG. 7 illustrates an apparatus for decoding audio data and extension data, according to an embodiment of the present invention. The apparatus in FIG. 7 may include a bitstream deformatter 700, an audio data decoding unit 710, a termination code detecting unit 720, a start code detecting unit 730, an extension type code detecting unit 740, an extension data decoding unit 750, and a data alignment unit 760, for example.

The bitstream deformatter 700 may receive and deformat a bitstream, e.g., as transmitted from an encoding unit through an input terminal IN, and output a payload.

The audio data decoding unit 710 may decode audio data in the payload output from the bitstream deformatter. According to an embodiment, the audio data decoding unit 710 may decode hierarchically encoded audio data.

The audio data decoding unit 710 may decode hierarchically encoded audio data using a BSAC method, for example. Here, according to an embodiment of the present invention, the audio data decoding unit 710 may perform a process indicated by reference numeral 1100 in the syntax shown in FIG. 11 to decode the audio data. Audio data having a frequency band corresponding to a base layer may be initially decoded, and then audio data having a frequency band corresponding to an upper layer, e.g., next to the base layer, may be decoded. This decoding may further be repeatedly performed until data having frequency bands corresponding to remaining layers are completely decoded.

Once the decoding of the audio data is completed, the audio data decoding unit 710 may align the decoded audio data in units of bytes. After the decoded data are aligned in units of bytes, the audio data decoding unit 710 may then fill the remaining portion with dummy data. According to an embodiment, the audio data decoding unit 710 may further perform a process indicated by reference numeral 1105 in the syntax shown in FIG. 11 to align the audio data in units of bytes.

If it is determined that there is an undecoded payload, after the decoding in the audio data decoding unit 710, the termination code detecting unit 720 may detect a termination code indicating the end of the payload of the encoded data in the deformatted payload. According to an embodiment, in a syntax using BSAC, the termination code may be implemented as 'zero_code'. Here, this 'zero_code' may be required to terminate arithmetic decoding and may include 32 consecutive '0's. The termination code detecting unit 720 may, thus, perform a process indicated by reference numeral 1105 shown in the syntax of FIG. 11.

The start code detecting unit 730 may detect a start code indicating a start of extension data in the payload deformatted by the bitstream deformatter 700. According to an embodiment, in a syntax using BSAC, the start code may be implemented as 'sync_word', with this 'sync_word' being a 4-bit code having 4 consecutive '1's. The start code detecting unit 730 may, thus, perform a process indicated by reference numeral 1120 shown in the syntax of FIG. 11.

If is determined that the number of bits in the undecoded payload is greater than a predetermined value, the extension type code detecting unit 740 may detect an extension type code indicating the type of the extension data. Here, as noted above, the extension type code is data indicating whether the available uses of the audio data will be extended for a specific purpose. The extension type code detecting unit 740 may, thus, perform a process indicated by reference numeral 1130 shown in the syntax of FIG. 11.

The determination as to whether the number of bits in the undecoded payload is greater than a predetermined value may be performed by the extension type code detecting unit 740, e.g., according to a process indicated by reference numeral 1125 shown in the syntax of FIG. 11. Here, the predetermined value may be 4, indicating the number of bits assigned to 'extension_type', noting that embodiments of the present invention are not limited thereto.

The extension data decoding unit 750 may decode extension data corresponding to the extension type code detected by the extension type code detecting unit 740. The extension data decoding unit 750 may, thus, perform processes indicated by reference numerals 1140 through 1197 shown in the syntax of FIG. 11.

The extension data decoding unit 750 may determine whether the extension code type detected by the extension type code detecting unit 740 is defined in the decoding unit. This, thus, may be performed according to a process indicated by reference numeral 1196 shown in the syntax of FIG. 11. For example, when the extension type codes, as shown in FIG. 3, are defined in the decoding unit, the extension data decoding unit 750 may determine whether the extension type code detected by the extension type code detecting unit 740 is '0010' or '1100', for example. If it is determined that the extension type code is not defined in the decoding unit, a data discarding portion 759 may discard a number of bits that is equal to the number of bits of the extension data, corresponding to the extension type code detected by the extension type code detecting unit 740. This process, thus, may be indicated by reference numeral 1197 shown in the syntax of FIG. 11. According to an embodiment, a detailed syntax is further shown in FIG. 14.

If it is determined that the extension type code is defined in the decoding unit, one of a first extension data decoding portion 751, . . . , and an $N^{th}$ extension data decoding portion 758, in the extension data decoding unit 750, decodes extension data corresponding to the extension type code detected by the extension type code detecting unit 740.

If the number of bits in the undecoded payload is determined to be greater than the predetermined value, after the extension data decoding unit 750 decodes the extension data, the extension type code detecting unit 740 and the extension data decoding unit 750 may repeatedly perform the above-described processes. If the number of bits in the undecoded payload is determined to be equal to or greater than the predetermined value, the data alignment unit 760 may align the extension data decoded by the extension data decoding unit 750 in units of bytes. The data alignment unit 760 may further fill the remaining bytes with dummy data. This process, thus, may be indicated by reference numeral 1198 shown in the syntax of FIG. 11.

Figure 8:
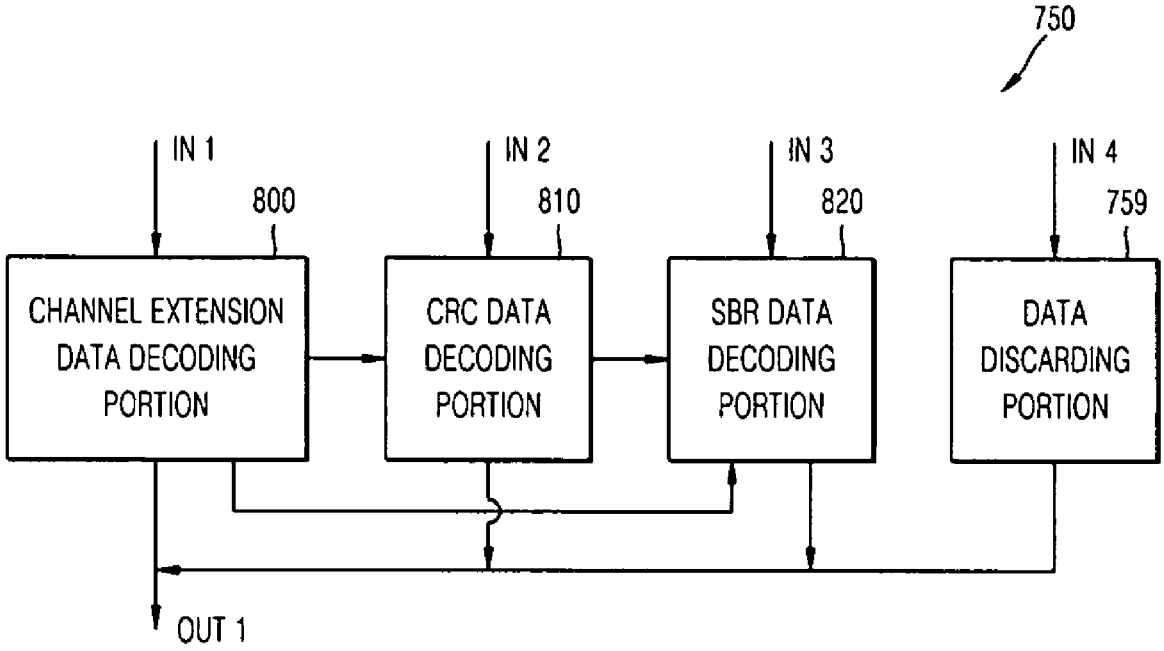
FIG. 8 illustrates an extension data decoding unit, according to an embodiment of the present invention.

FIG. 8 illustrates the extension data decoding unit 750, according to an embodiment of the present invention.

If the extension type code, e.g., detected by the extension type code detecting unit 740, is '1111', a channel extension data decoding portion 800 may decode extension data for extending the channel of the audio data.

If the extension type code, e.g., detected by the extension type code detecting unit 740, is '0000', an SBR data decoding portion 820 may decode extension data for extending the bandwidth of the audio data using an SBR tool, for example.

If the extension type code, e.g., detected by the extension type code detecting unit 740, is '0001', a CRC data decoding portion 810 may decode extension data for generating a CRC code for checking for transmission errors of the extension data of extending the bandwidth of audio data, and the SBR data decoding portion 820 may decode the extension data for extending the bandwidth of the audio data using an SBR tool, for example.

If the extension type code, e.g., detected by the extension type code detecting unit 740, is '1110', the channel extension data decoding portion 800 may decode extension data for expanding the channel of the audio signal, and the SBR data decoding portion 820 may decode extension data for extending the bandwidth of the audio data using an SBR tool, for example.

If the extension type code, e.g., detected by the extension type code detecting unit 740, is '1101', the channel extension data decoding portion 800 may decode extension data for expanding the channel of the audio data, the CRC data decoding portion 810 may decode extension data for generating a CRC code for checking for transmission errors of the extension data of extending the bandwidth of audio data, and the SBR data decoding portion 820 may decode extension data for expanding the bandwidth of the audio data using an SBR tool, for example.

Figure 9:
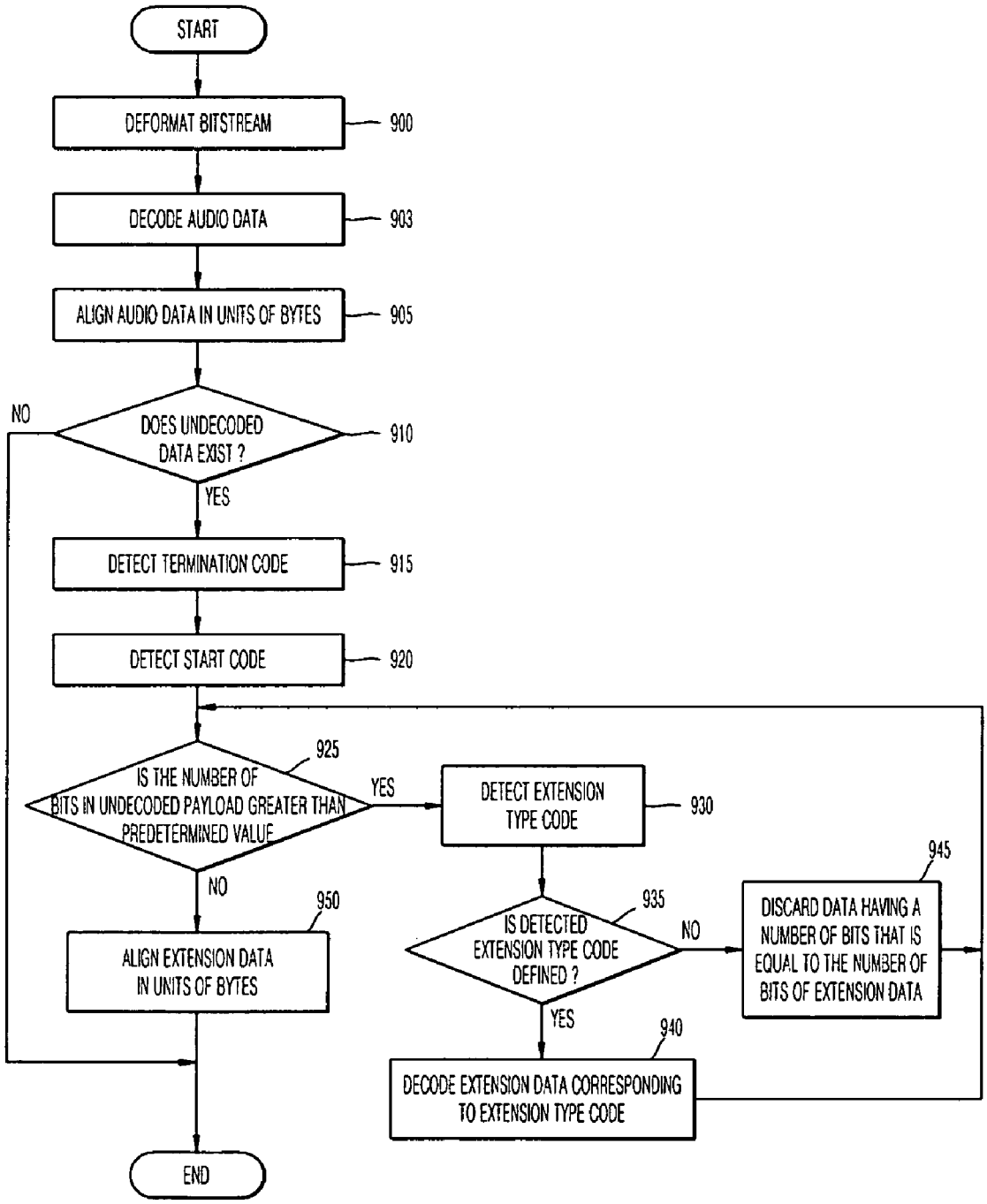
FIG. 9 illustrates a method of decoding audio data and extension data, according to an embodiment of the present invention.

FIG. 9 illustrates a method of decoding audio data and extension data, according to an embodiment of the present invention.

Initially, a transmitted bitstream may be deformatted, and a payload in the bitstream output, in operation 900.

Audio data in the payload, output in operation 900, may be decoded, in operation 903. Here, according to an embodiment, in operation 903, hierarchically encoded audio data may be decoded.

In operation 903, such encoded audio data may be decoded according to a BSAC method, e.g., according to a process indicated by reference numeral 1100 shown in the syntax of FIG. 11. Audio data having a frequency band corresponding to a base layer may initially be decoded, and then audio data having a frequency band corresponding to an upper layer, e.g., next to the base layer, may be decoded. These decoding processes may be repeatedly performed until audio data having frequency bands corresponding to remaining layers are completely decoded.

The audio data decoded in operation 903 may be aligned in units of bytes, in operation 905, with remaining portions of the audio data that are not aligned being filled with dummy data. Here, according to an embodiment, operation 905 may be performed according to a process indicated by reference numeral 1105 shown in the context of FIG. 11.

After operation 905, it may be determined whether there is undecoded data in the payload, e.g., output in operation 900, in operation 910. Here, according to an embodiment, operation 910 may be performed according to a process indicated by reference numeral 1110 shown in syntax of FIG. 11.

If it is determined that the payload does not include undecoded data, the decoding of the bitstream, e.g., as received in operation 900, may be terminated.

If it is determined that the payload includes undecoded data, a termination code indicating a end of the payload of the encoded audio data may be detected from the payload, e.g., as deformatted in operate 900, in operation 915. In a syntax using BSAC, the termination code may be implemented as 'zero_code'. Here, this 'zero_code' may be required for arithmetic decoding and have 32 consecutive '0's. According to an embodiment, operation 915 may be performed according to a process indicated by reference numeral 1105 shown in the syntax of FIG. 11.

After operation 915, a start code indicating a start of the extension data may be detected in the deformatted payload, in operation 920. In a syntax using BSAC, the start code may be implemented as 'sync_word', with this 'sync_word' being a 4-bit code having 4 consecutive 1's. According to an embodiment, operation 920 may be performed according to a process indicated by reference numeral 1120 shown in the syntax of FIG. 11.

After operation 920, it may be determined whether the number of bits in the undecoded payload is greater than a predetermined value, in operation 925. Here, according to an embodiment, operation 925 may be performed according to a process indicated by reference numeral 1125 shown in the syntax of FIG. 11. In the embodiment shown in FIG. 11, the predetermined value is set to 4, which indicates the number of bits assigned to 'extension_type', noting that embodiments of the present invention are not limited thereto.

If it is determined that the number of bits in the undecoded payload is equal to or smaller than the predetermined value, extension data to be decoded in operation 940 may be aligned in units of bytes, in operation 950. The remaining portion of bytes, in which the extension data is not aligned in units of bytes, may be filled with dummy data. According to an embodiment, operation 950 may be performed according to a process indicated by reference numeral 1198 shown in the syntax of FIG. 11.

If it is determined that the number of bits in the undecoded payload is greater than the predetermined value, an extension type code indicating the type of the extension data encoded in the encoding unit may be detected, in operation 930. Here, as noted above, the extension type code is data indicating whether the available uses of the audio data will be extended for a specific purpose. According to an embodiment, operation 930 may be performed according to a process indicated by reference numeral 1130 shown in the syntax of FIG. 11.

It may further be determined whether the extension type code, detected in operation 930, is defined in the decoding unit, in operation 935. Here, according to an embodiment, operation 935 may be performed according to a process indicated by reference numeral 1196 shown in the syntax of FIG. 11. For example, when the extension type codes, as shown in FIG. 3, are defined in the decoding unit, in operation 935, it may be determined whether the extension type code detected in operation 930 is '0010' or '1100'.

If it is determined that the detected extension type code is defined in the decoding unit, extension data corresponding to the extension type code detected in operation 930 may be decoded, in operation 940. Here, according to an embodiment, operation 940 may be performed according to processes indicated by reference numerals 1140 through 1195 shown in the syntax of FIG. 11.

If it is determined that the detected extension type code is not defined in the decoding unit, a number of bits that is equal to the number of bits of the extension data, corresponding to the extension type code detected in operation 930, may be discarded, in operation 945. Here, according to an embodiment, operation 945 may be performed according to a process indicated by reference numeral 1197 shown in the syntax of FIG. 11. This process of reference numeral 1197 is shown in more detail in FIG. 14.

After operation 940 or operation 950, operation 925 may be repeatedly performed.

Figure 10:
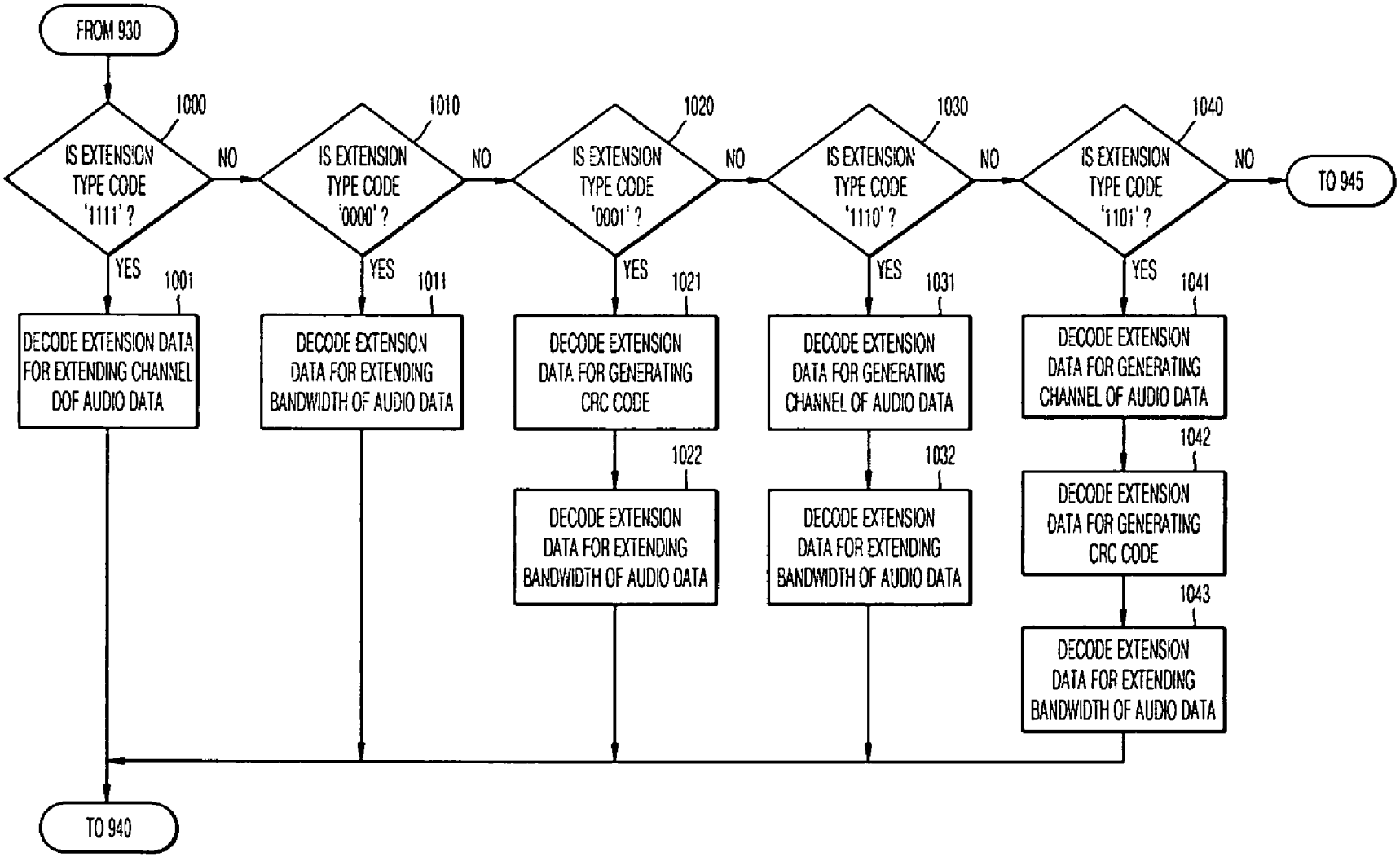
FIG. 10 illustrates an operation in a method of decoding audio data and extension data, such as operation 940 of FIG. 9, according to an embodiment of the present invention.

FIG. 10 illustrates operation 940 in the method of decoding audio data and extension data, according to an embodiment of the present invention. Operation 940 will be further described with reference to FIGS. 11 through 13, with FIG. 13 showing a syntax of a process used in FIG. 12.

It may be determined whether the extension type code, e.g., detected in operation 930, is '1111', in operation 1000. Here, according to an embodiment, operation 1000 may be performed according to a process indicated by reference numeral 1140 shown in the syntax of FIG. 11.

If it is determined that the extension type code is '1111', extension data for extending the channel of the audio data may be decoded, in operation 1001. Here, according to an embodiment, operation 1001 may be performed according to a process indicated by reference numeral 1145 shown in the syntax of FIG. 11.

If it is determined that the extension type code is not '1111', it may be determined whether the extension type code detected in operation 930 is '1010', in operation 1010. Here, according to an embodiment, operation 1010 may be performed according to a process indicated by reference numeral 1150 shown in the syntax of FIG. 11.

If it is determined that the extension type code is '0000', extension data for extending the bandwidth of the audio data may be decoded, in operation 1011. Here, according to an embodiment, operation 1011 may be performed according to a process indicated by reference numeral 1155 shown in the syntax of FIG. 11. The process 1155 is shown in greater detail in FIG. 12.

If it is determined that the extension type code is not '1010', it may be determined whether the extension type code detected in operation 930 is '0001', in operation 1020. Here, according to an embodiment, operation 1020 may be performed according to a process indicated by reference numeral 1160 shown in the syntax of FIG. 11, for example.

If it is determined that the extension type code is '0001', extension data for generating a CRC code for checking for transmission errors of the extension data of extending the bandwidth of audio data may be decoded, in operation 1021. After operation 1021, extension data for extending the bandwidth of the audio data may be decoded, in operation 1022. Here, according to an embodiment, operations 1021 and 1022 may be performed according to a process indicated by reference numeral 1165 shown in the syntax of FIG. 11. The process 1165 is shown in greater detail in FIG. 12.

If it is determined that the extension type code is not '0001', it may be determined whether the extension type code detected in operation 930 is '1110', in operation 1030. Here, according to an embodiment, operation 1030 may be performed according to a process indicated by reference numeral 1170 shown in the syntax of FIG. 11.

If it is determined that the extension type code is '1110', extension data for extending the channel of the audio data may be decoded, in operation 1031. After operation 1031, extension data for extending the bandwidth of the audio data may be decoded, in operation 1032. Here, according to an embodiment, operation 1031 may be performed according to a process indicated by reference numeral 1175 shown in the syntax of FIG. 11, and operation 1032 may be performed according to a process indicated by reference numeral 1180 shown in the syntax of FIG. 11. The process 1180 is shown in greater detail in FIG. 12.

If it is determined that the extension type code is not '1110', it may be determined whether the extension type code detected in operation 930 is '1101', in operation 1040. Here, according to an embodiment, operation 1040 may be performed according to a process indicated by reference numeral 1185 shown in the syntax of FIG. 11.

If it is determined that the extension type code is '1101', extension data for extending the channel of the audio data may be decoded, in operation 1041. After operation 1041, extension data for generating a CRC code for checking for transmission errors of the extension data of extending the bandwidth of audio data may be decoded, in operation 1042. After operation 1042, extension data for extending the bandwidth of the audio data may be decoded, in operation 1043. Here, according to an embodiment, operation 1041 may be performed according to a process indicated by reference numeral 1190 shown in the syntax of FIG. 11, and operations 1042 and 1043 may be performed according to a process indicated by reference numeral 1195 shown in the syntax of FIG. 11. The process 1195 is shown in greater detail in FIG. 12. Lastly, FIG. 15 illustrates a table of definition of payloads in syntaxes, according to an embodiment of the present invention.

In addition to the above described embodiments, embodiments of the present invention can also be implemented through computer readable code/instructions in/on a medium, e.g., a computer readable medium, to control at least one processing element to implement any above described embodiment. The medium can correspond to any medium/media permitting the storing and/or transmission of the computer readable code.

The computer readable code can be recorded/transferred on a medium in a variety of ways, with examples of the medium including magnetic storage media (e.g., ROM, floppy disks, hard disks, etc.), optical recording media (e.g., CD-ROMs, or DVDs), for example. The media may also be a distributed network, so that the computer readable code is stored/transferred and executed by the distributed network. Still further, as only an example, the processing element could include a processor or a computer processor, and processing elements may be distributed and/or included in a single device.

According to an embodiment of the present invention, audio data may be hierarchically encoded, and at least one extension data of the audio data encoded using at least one encoding method and decoded in a similar manner, thereby ensuring FGS and unlimited extendibility of the audio data.

In addition, according to an embodiment of the present invention, a 4-bit sync_word indicating a start of encoded extension data and a 4-bit extension_type indicating a type of the extension data, which form a 8-bit extension type code, have been set forth. Therefore, as an example, embodiments of the present invention have backward compatibility relating to the conventional syntax of FIG. 1A.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An audio encoding method, comprising:

encoding audio data using at least one encoding method;

selecting an extension type code indicating a type of extension data to be added to the encoded audio data, the extension type code being selected from plural extension type codes identifying defined types of extension data, including a type of data for extending a select channel, from plural available channels, of the audio data, a type of data for extending a bandwidth of the audio data, and a type of data for the extending of the select channel of the audio data and for an extending of a bandwidth of the extended channel, different from the extending of the bandwidth of the audio data; and encoding the extension type code indicating the type of the extension data and the extension data corresponding to the extension type code, in addition to the encoded audio data, for the encoded audio data using at least one encoding method.

2. The encoding method of claim 1, wherein, in the encoding of the audio data, the audio data is hierarchically encoded using a first encoding method, and in the encoding of the extension data, the extension data is encoded using at least one encoding method, including the first encoding method.

3. The encoding method of claim 1, wherein the encoding of the extension data comprises encoding data for extending the select channel of the audio data to generate the select channel of the audio data and an additional channel of the audio data when the audio data is decoded.

4. The encoding method of claim 1, wherein the encoding of the extension data comprises at least encoding data for extending the bandwidth of the audio data.

5. The encoding method of claim 1, wherein additional extension data for the audio data is encoded and includes at least one selected from data for checking for transmission errors, metadata of the audio data, and a fill element of the audio data.

6. The encoding method of claim 1, further comprising:

generating a start code indicating a start of an encoded portion of the extension data.

7. The encoding method of claim 6, further comprising:

inserting an end code indicating an end of an encoded portion of the audio data, immediately after the encoded portion of the audio data, wherein the generating of the start code further comprises inserting the start code after the inserted end code, and the generating of the extension type code further comprises inserting the extension type code after the inserted start code.

8. The encoding method of claim 6, wherein the start code is a 4-bit code with four consecutive identical bits, and the extension type code is a different 4-bit code.

9. The encoding method of claim 1, wherein the encoding of the extension data comprises at least one of hierarchically encoding data for extending the select channel of the audio data and encoding data for extending the bandwidth of the audio data.

10. The encoding method of claim 1, wherein the extension type code is selected from respective extension type codes identifying defined types of the type of data for extending the select channel of the audio data, the type of data for extending the bandwidth of the audio data, the type of data for the extending of the select channel of the audio data and for the extending of the bandwidth, and a type of data for extending the bandwidth of the audio data and for checking for transmission errors.

11. The encoding method of claim 10, wherein the extension type code is selected from respective extension type codes identifying defined types of the type of data for extending the select channel of the audio data, the type of data for extending the bandwidth of the audio data, the type of data for the extending of the select channel of the audio data and for the extending of the bandwidth, the type of data for extending the bandwidth of the audio data and for checking for transmission errors, and a type of data for the extending of the select channel of the audio data, for the extending of the bandwidth, and for checking for transmission errors.

12. The encoding method of claim 1, wherein, when the selected extension type code is the type of data for the extending of the select channel of the audio data and for the extending of the bandwidth, the selected extension type code indicates the subsequent presence of channel extension data of the audio data and data of a bandwidth extension particular to the extended channel.

13. The encoding method of claim 1, wherein, when plural extension data for the encoded audio data are encoded, the encoding method further comprises repeatedly encoding an extension type code, of the plural extension type codes, with each extension data, before an encoding of a next extension type code, of the plural extension type codes, and corresponding extension data.

14. The encoding method of claim 1, further comprising:

inserting another extension type code indicating a type of a different extension data after an encoded portion of the extension data; and encoding the extension data, wherein the adding of the other extension type code and the encoding of the least one extension data are repeatedly performed for plural extension data with respective extension type codes until all extension data are encoded.

15. At least one computer readable medium comprising computer readable code to control at least one processing device to implement the method of claim 1.

16. An audio encoding method, comprising:

encoding multi-channel audio data using at least one encoding method; and encoding a extension type code indicating a type of extension data and the extension data corresponding to the extension type code, in addition to the encoded audio data, for the encoded audio data using at least one encoding method, wherein the encoding of the extension data comprises hierarchically encoding channel extension data for extending a select channel, from plural available channels, of the audio data and bandwidth extension data for extending a bandwidth of the extended channel of the audio data, different from an extending of the bandwidth of the audio data without channel extension.

17. An encoding method, comprising:

encoding audio data using at least one encoding method;

selecting a type code indicating a type of extension data to be added to the encoded audio data, the type code being selected from respective codes identifying defined types of a type of data for extending a channel of the audio data, a type of data for extending a bandwidth of the audio data, and a type of data for the extending of the channel of the audio data and for the extending of the bandwidth;

encoding the type code indicating the type of the extension data and the extension data corresponding to the type code, in addition to the encoded audio data, for the encoded audio data using at least one encoding method;

inserting another code indicating a type of a different extension data after an encoded portion of the extension data; and encoding the extension data, wherein the adding of the other code and the encoding of the least one extension data are repeatedly performed until all extension data are encoded.

18. An audio encoding apparatus, comprising:

a first encoding unit to encode audio data using at least one encoding method;

a extension type code generating unit to select an extension type code indicating a type of extension data to be added to the encoded audio data, the extension type code being selected from respective extension type codes identifying defined types of extension data, including a type of data for extending a select channel, of plural available channels, of the audio data, a type of data for extending a bandwidth of the audio data, and a type of data for the extending of the select channel of the audio data and for extending a bandwidth corresponding to the extended channel; and a second encoding unit to encode the selected extension type code indicating the type of at the least one extension data and the extension data corresponding to the extension type code, in addition to the encoded audio data, for the encoded audio data using at least one encoding method, wherein, when the selected extension type code represents a type of extension data including the type of data extending of the select channel of the audio data and the extending of the bandwidth corresponding to the extended channel, data for respective bandwidth extensions for each of one or more select channels are separately encoded with respective channel extension data for each extended channel.

19. An audio decoding method, comprising:

decoding encoded audio data in an encoded data bitstream using at least one decoding method;

detecting an extension type code in the bitstream indicating a type of extension data for the encoded audio data, the extension type code being detected as being from respective extension type codes identifying defined types of extension data, including a type of data for extending a select channel, of plural available channels, of the audio data, a type of data for extending a bandwidth of the audio data, and a type of data for the extending of the select channel of the audio data and for extending a bandwidth corresponding to the extended channel; and decoding the extension data corresponding to the detected extension type code, in addition to the encoded audio data, for the encoded audio data using at least one decoding method, wherein, when the detected extension type code represents a type of extension data including the type of data extending of the select channel of the audio data and the extending of the bandwidth corresponding to the extended channel, data for respective bandwidth extensions for each of one or more select channels are separately decoded with respective channel extension data for each extended channel.

20. The decoding method of claim 19, wherein, in the decoding of the audio data, the audio data is hierarchically decoded using a first decoding method, and in the decoding of the extension data, the extension data is decoded using at least one decoding method, including the first decoding method.

21. The decoding method of claim 19, wherein the decoding of the extension data comprises decoding data for extending a channel.

22. The decoding method of claim 19, wherein the decoding of the extension data comprises decoding data for extending a bandwidth of the audio data.

23. The decoding method of claim 19, wherein the decoding of the extension data comprises decoding data for extending a bandwidth of the audio data and decoding data for checking for transmission errors.

24. The decoding method of claim 19, wherein additional extension data for the audio data is decoded and includes data for checking for transmission errors of the audio data, metadata of the audio data, and a fill element of the audio data.

25. The decoding method of claim 19, further comprising:

detecting a start code indicating a start of an encoded portion of the extension data.

26. The decoding method of claim 25, further comprising:

detecting an end code indicating an end of an encoded portion of the audio data, immediately after the encoded portion of the audio data, wherein the detecting of the start code further comprises detecting the start code after the end code when the end code is detected, and the detecting of the extension type code further comprises detecting the extension type code after the start code when the start code is detected.

27. The decoding method of claim 25, wherein the start code is a 4-bit code with four consecutive identical bits, and the extension type code is a different 4-bit code.

28. The decoding method of claim 19, further comprising:

detecting another extension type code indicating a type of a different extension data for the encoded audio data after an encoded portion of the extension data; and decoding the different extension data using a decoding method according to the detected other extension type code when the other extension type code indicates the type of the different extension data, wherein the detecting of the other extension type code and the decoding of the different extension data are repeatedly performed until all extension data for the encoded audio data are decoded.

29. The decoding method of claim 19, wherein the extension type code is detected as being from respective extension type codes identifying defined types of the type of data for extending the select channel of the audio data, the type of data for extending the bandwidth of the audio data, the type of data for the extending of the select channel of the audio data and for the extending of the bandwidth, and a type of data for extending the bandwidth of the audio data and for checking for transmission errors.

30. The decoding method of claim 29, wherein the extension type code is detected as being from respective extension type codes identifying defined types of the type of data for extending the select channel of the audio data, the type of data for extending the bandwidth of the audio data, the type of data for the extending of the select channel of the audio data and for the extending of the bandwidth, the type of data for extending the bandwidth of the audio data and for checking for transmission errors, and a type of data for the extending of the select channel of the audio data, for the extending of the bandwidth, and for checking for transmission errors.

31. The decoding method of claim 19, wherein the decoding of the extension data comprises at least one of hierarchically decoding data for extending a select channel of the audio data and decoding data for extending a bandwidth of the audio data.

32. At least one computer readable medium comprising computer readable code to control at least one processing device to implement the method of claim 19.

33. An audio decoding method, comprising:

decoding encoded multi-channel audio data using at least one decoding method; and detecting an extension type code indicating an extension type of extension data and decoding the extension data corresponding to the extension type code, in addition to the encoded audio data, for the encoded audio data using at least one decoding method, wherein the decoding of the extension data comprises hierarchically decoding data for extending a select channel, of plural available channels, of the audio data and decoding data for extending a bandwidth of the extended channel of the audio data, as defined by the detected extension type code, wherein, when the detected extension type code represents a type of extension data including the type of data extending of the select channel of the audio data and the extending of the bandwidth of the extended channel, data for respective bandwidth extensions for each of one or more select channels are separately decoded with respective channel extension data for each extended channel.

34. An audio decoding apparatus, comprising:

a first decoding unit to decode encoded audio data from encoded data in a bitstream using at least one decoding method; and a second decoding unit to detect an extension type code in the bitstream indicating a type of extension data for the encoded audio data, the extension type code being detected as being from respective extension type codes identifying defined types of encoding data, including a type of data for extending a select channel, of plural available channels, of the audio data, a type of data for extending a bandwidth of the audio data, and a type of data for the extending of the select channel of the audio data and for an extending of a bandwidth corresponding to the extended channel, and to decode the extension data corresponding to the detected extension type code, in addition to the encoded audio data, for the encoded audio data using at least one decoding method, wherein, when the detected extension type code represents the type of extension data including the type of data extending of the select channel of the audio data and the extending of the bandwidth corresponding to the extended channel, data for respective bandwidth extensions for each of one or more select channels are separately decoded with respective channel extension data for each extended channel.

35. An audio encoding method comprising:

encoding an audio data;

generating a code indicating the end of payload of the encoded audio data;

generating a code indicating the start of the payload of an extension data for the encoded audio data; and encoding an extension data and an extension type code, selected from plural extension type codes as corresponding to a data type the extension data;

wherein the extension data is at least one of a first extension data type extending a select channel, of plural available channels, of the audio data and extending a bandwidth corresponding to the extended channel, and a second extension data type extending the select channel of the audio data, extending the bandwidth corresponding to the extended channel, and a checking of a transmission error, with the extending of the bandwidth of the extended channel being different from an extending of a bandwidth of the audio data without channel extension.

36. An audio encoding method comprising:

encoding an audio data;

generating a code indicating the end of payload of the encoded audio data;

generating a code indicating the start of the payload of an extension data for the encoded audio data; and encoding an extension data and an extension type code, selected from plural extension type codes as corresponding to a data type of the extension data;

wherein the extension data is at least one of a first extension type extending a select channel, of plural available channels, of the audio data and extending a bandwidth of corresponding to the extended channel, and a second extension type extending the select channel of the audio data, extending the bandwidth corresponding to the extended channel, and a checking of a transmission error, wherein the extending of the bandwidth of the extended channel is different from an extending of a bandwidth of the audio data without channel extension, and wherein the generation of the extension type and the encoding of the extension data are processed repeatedly until all extension data for the encoded audio data are encoded.

37. An audio decoding method comprising:

decoding an encoded audio data;

detecting a code indicating the end of payload of the encoded audio data;

detecting a code indicating the start of the payload of an extension data for the encoded audio data;

detecting an extension type code, of plural extension type codes, each representing different data types of extension data; and decoding an encoded extension data based on the detected extension type code;

wherein the encoded extension data is at least one of a first extension type extending a select channel, of plural available channels, of the audio data and extending a bandwidth corresponding to the extended channel, and a second extension type extending the select channel of the audio data, extending the bandwidth corresponding to the extended channel, and a checking of a transmission error, and wherein, when the detected extension type code represents a type of extension data including a type of data extending of the select channel of the audio data and extending the bandwidth corresponding to the extended channel, data for respective bandwidth extensions for each of one or more select channels are separately decoded with respective channel extension data for each extended channel.

38. An audio decoding method comprising:

decoding an encoded audio data;

detecting a code indicating the end of payload of the encoded audio data;

detecting a code indicating the start of the payload of an extension data for the encoded audio data;

detecting an extension type code, of plural extension type codes, each representing different data types of extension data; and decoding an encoded extension data based on the detected extension type code;

wherein the extension data is at least one of a first extension type extending a select channel, of plural available channels, of the audio data and extending a bandwidth corresponding to the extended channel, and a second extension type extending the select channel of the audio data, extending the bandwidth corresponding to extended channel, and a checking of a transmission error, wherein, when the detected extension type code represents a type of extension data including a type of data extending of the select channel of the audio data and extending the bandwidth corresponding to the extended channel, data for respective bandwidth extensions for each of one or more select channels are separately decoded with respective channel extension data for each extended channel, and wherein the detection of the extension type code and the decoding of the encoded extension data based on the detected extension type code are processed repeatedly for different extension data based on respective extension type codes until all extension data for the encoded audio data are decoded.

39. An audio decoding method comprising:

decoding an encoded audio data;

detecting 'zero code';

detecting 'sync code';

detecting an 'extension type', of one or more extension types, of encoded extension data for the decoded audio data after the decoding of the encoded audio data, detecting of the 'zero code', and detecting of the 'sync' code; and decoding the encoded extension data based on the detected 'extension type';

wherein the encoded extension data is at least one of a first extension type extending a select channel, of plural available channels, of the audio data and extending the bandwidth of the audio data, and a second extension type extending the select channel of the audio data, extending the bandwidth of the audio data, and a checking of a transmission error.

40. An audio decoding method comprising:

decoding an encoded audio data;

detecting 'zero code';

detecting 'sync code';

detecting an 'extension type', of one or more extension types, of encoded extension data for the decoded audio data after the decoding of the encoded audio data, detecting of the 'zero code', and detecting of the 'sync' code; and decoding the extension data based on the detected 'extension type';

wherein the encoded extension data is at least one of a first extension type extending a select channel, of plural available channels, of the audio data and extending the bandwidth of the audio data, and a second extension type extending the select channel of the audio data, extending the bandwidth of the audio data, and a checking of a transmission error, and wherein the detection of the extension type and the decoding of the encoded extension data are processed repeatedly for different extension data based upon respective detected extension types until all extension data for the encoded audio data are decoded.

41. An audio decoding method comprising:

decoding an encoded audio data;

detecting an end code indicating an end of a payload of the encoded audio data;

detecting a start code indicating a start of a payload of an extension data for the encoded audio data;

detecting an extension type, from plural available extension types, of encoded extension data for the decoded audio data after the decoding of the encoded audio data, the detecting of the end code, and the detecting of the start code; and decoding the encoded extension data based on the detected extension type, wherein the plural available extension types include a first type of data extending a select channel, of plural available channels, of the audio data, a second type of data extending a bandwidth of the audio data, a third type of data extending the bandwidth of the audio data and checking a transmission error, a fourth type of data of extending the select channel of the audio data and extending the bandwidth of the audio data, and a fifth type of data extending the select channel of the audio data, extending the bandwidth of the audio data, and checking a transmission error.

42. The decoding method of claim 41, wherein, when a value of the extension type is '1111', the extension type is the first type, when the value of the extension type is '0000', the extension type is the second type, when the value of the extension type is '0001', the extension type is the third type, when the value of the extension type is '1110', the extension type is the fourth type, when the value of the extension type is '1101', the extension type is the fifth type.

43. An audio encoding method, comprising:

encoding multi-channel audio data using at least one encoding method; and encoding, after the encoding of the audio data, extension data of the audio data and at least one extension type code, of plural extension type codes, indicating a type the extension data, wherein, when plural extension data for the encoded audio data are encoded, the encoding method further comprises encoding a first extension type code, of the plural extension type codes, with at least one first extension data of the encoded audio data, and then encoding a second extension type code, of the plural extension type codes, with at least one second extension data of the encoded audio data.

44. The encoding method of claim 43, wherein the first extension data includes at least data for extending a first channel of the audio data, and the second extension data includes at least data for extending a second channel of the audio data.

45. The encoding method of claim 44, wherein the plural channels include at least front left/right (FL/FR) channel, a center (C) channel, and a side left/right (SL/SR) channel.

46. The encoding method of claim 43, wherein the first extension data includes data for extending a first channel of the audio data and data for extending a bandwidth of the first channel of audio data, and the second extension data includes data extending a second channel of the audio data and data for extending a bandwidth of the second channel of audio data.

* * * * *

UNITED STATES PATENT AND TRADEMARK OFFICE

CERTIFICATE OF CORRECTION

PATENT NO. : 8,055,500 B2
APPLICATION NO. : 11/546433
DATED : November 8, 2011
INVENTOR(S) : Junghoe Kim et al.

It is certified that error appears in the above-identified patent and that said Letters Patent is hereby corrected as shown below:

Column 21, Line 63, In Claim 35, delete "data type the extension" and insert -- data type of the extension --, therefor.

Column 23, Line 32, In Claim 39, delete "'sync' code;" and insert -- 'sync code'; --, therefor.

Column 23, Line 50 (Approx.), In Claim 40, delete "'sync' code;" and insert -- 'sync code'; --, therefor.

Column 24, Line 39-40, In Claim 43, delete "type the extension" and insert -- type of the extension --, therefor.

Signed and Sealed this
Fourteenth Day of February, 2012

David J. Kappos

David J. Kappos
*Director of the United States Patent and Trademark Office*